US005683081A

United States Patent [19]

Takatoshi et al.

[11] Patent Number: 5,683,081

[45] Date of Patent: Nov. 4, 1997

[54] GAME APPARATUS

[75] Inventors: Takemoto Takatoshi; Kawashima Kazunari, both of Tokyo, Japan

[73] Assignee: Kabushiki Kaisha Ace Denken, Tokyo, Japan

[21] Appl. No.: 325,268

[22] PCT Filed: Feb. 22, 1993

[86] PCT No.: PCT/JP93/00523

§ 371 Date: Jan. 9, 1995

§ 102(e) Date: Jan. 9, 1995

[87] PCT Pub. No.: WO93/22015

PCT Pub. Date: Nov. 11, 1993

[30] Foreign Application Priority Data

Apr. 28, 1992 [JP] Japan ..... 4-110364
Jun. 25, 1992 [JP] Japan ..... 4-167208

[51] Int. Cl.[6] ..... A63F 7/02

[52] U.S. Cl. ..... 273/121 B

[58] Field of Search ..... 273/118–121

[56] References Cited

FOREIGN PATENT DOCUMENTS 63-122487 5/1988 Japan .
1-175880 7/1989 Japan .
2-252480 10/1990 Japan .
3-131286 6/1991 Japan .
3-212283 9/1991 Japan .
3-289981 12/1991 Japan .

*Primary Examiner*—Raleigh W. Chiu
*Attorney, Agent, or Firm*—Armstrong, Westerman, Hattori, McLeland & Naughton

[57] ABSTRACT

A game machine capable of reducing the operating expenses by carrying out the dispense of pachinko balls by a single pachinko ball dispenser, and capable of dispensing pachinko balls efficiently; and a pachinko ball dispenser adapted to accurately and speedily dispense an optional number of pachinko balls used in this machine. A game machine (40) has a pachinko ball dispenser (101) adapted to recieve a dispensing signal which is outputted from a controller (50) on the basis of a money signal from a rental ball dispensing unit (30), and a prize signal which is also outputted from the controller (50) on the basis of prescribed rules, counts pachinko balls the munber of which corresponds to these signals and dispenses pachinko balls into a player's ball tray (11). The pachinko ball dispenser (101) has a rotatable ratchet wheel (110) facing the interior of a pachinko ball passage (171) and provided in the periphery thereof with concave portions (110*a*) in each of which one pachinko ball is fitted, this ratchet wheel being rotated continuously until the number of dispensed balls has reached to an ordered number, then switched to intermittent rotation, and stopped when the number of dispensed balls has reached the ordered number.

7 Claims, 11 Drawing Sheets

GAME APPARATUS

TECHNICAL FIELD

The present invention relates to a game machine comprising a rent ball dispensing unit for dispensing pachinko balls equivalent to an amount of money put into slot of the dispensing unit by a player, a game machine (especially a slot machine using a pachinko ball) using a pachinko ball as game medium insted of a medal and a controller for controlling the rent ball dispensing unit and the game machine collectively.

Furthermore, the present invention relates to a method and apparatus for dispensing pachinko balls with counting a prescribed number of pachinko balls so as to do automatically supplying pachinko balls to a game machine, dispensing prize balls from the game machine and dispensing rental balls from a rent ball dispensing unit.

BACKGROUND ART

In the prior art of the slot machine using patinko balls as game medium (hereinafter referred to as pachinko slot machine), at the bigining of the game, a game player puts coins into the slot of a rental ball dispenser provided in the side part of the pachinko slot machine, then a rental ball counter in the rental ball dispenser counts the pachinko balls equivalent to the amount of money throwing in the slot of the dispenser and the dispenser dispenses the counted pachinko balls, and then the player takes them in a ball tray mounted on a front part of the pachinko slot machine.

Recently a swingable pipe supplys pachinko balls from the rental ball dispenser to the ball tray of the pachinko slot machine, therefore pachinko balls can be supplied from the rental ball dispenser to the game machine. Furethermore a prize ball counter is mounnted within the game machine.

A regular number of pachinko balls are supplied in an upper tray mounted on the upper part of the back side of the game machine and they are dispensed as prize balls. Pachinko balls in a supplying gutter mounted on a game machine island are standed in a line in each shoot and when the upper tray of the game machine is empty, an empty signal is transmitted to a main computer and the pachinko balls are provided in the upper tray by a pipe means what is called bellows, under controlling of the main computer, via a supply ball counter mounted on a game machine island portion above the game machine. Pachinko balls in the upper tray are standed in a line and also provided to the prize ball counter of the game machine.

For the rental ball counter, pachinko balls in the supply gutter are standed in a line by the shoot and are sent to the counter via bellows which connect the shoot with the counter so pachinko balls are dispensed corresponding to the amount of the money put into a slot of the dispenser.

As a pachnko ball dispenser (what is to say ball counter), generally in said game machine and rent ball dispenser, for automatic supplying of pachinko balls to a game machine, dispensing prize balls from the game machine and dispensing pachinko balls from a rental ball dispenser, the apparatus disclosed in the Published Unexamined Utility Model Application of Provisional Publication No. Showa 61 (1986)-82678 is well known to the art. In this invention, a sprocket formed plural concave portions in its periphery, each concave portion catches one pachinko ball, is mounted rotatably so that concave portions may face an interior of a pachinko ball passage. In the passage, pachinko balls dropping with the gravity are catched separately with the concave portions and the sprocket is surely rotated by the pachinko ball. The pachinko balls are detected and counted by an optical sensor provided in a downstream part of the passage, and a prescribed number of the pachinko balls are dischareged from the lower portion of the passage by controlling rotation of the sprocket. Control of rotation of the sprocket is done by locking and unlocking the sprocket with a stopper.

Releasing the stopper, the pachinko balls fall down to the lower part of the passage with rotating the sprocket continuously and are dispensed from the lower portion. When the optical senser counts a prescribed number of the pachinko balls, the stopper locks the sprocket and the dispense of the pachinko balls is stopped. Although, in this case, the stopper must be locked the sprocket timely after the optical senser counts a prescribed number of the pachinko balls or before the counting is finished, but passing speed of the pachinko balls are uneven and the working of the stopper solenoid is delayed (by dust and/or a change with the passage of time); therefore a correct dispense of the pachinko balls is difficult.

The abovementioned prior art needs the shoot and bellows for supplying pachinko balls from the gutter to the counters separately since the rental ball counter and the prize ball counter are provided individually; furthermore, the prior art needs to mount another supply counter and an upper tray on an upper part of a game machine therefore an amount of work and the cost of production are incleased.

In the case of dispensing pachinko balls by a prize ball counter, pachinko balls in a supply gutter are once standed in a line in a shoot and stored in an upper tray in a scattered state, and then the balls are again standed in a line to be passed to the prize ball counter; therefore not a few time is needed to dispense pachinko balls, and so large amount dispense of the balls is not efficent, and troubles such as ball jaming, etc. inclease.

Furthermore in the prior art pachinko ball dispenser, after the prescribed number of the pachinko balls have counted until said stopper stops the rotation of the sprocket, the sprocket rotates more than one tooth (one concave portion) passing; therefore sometimes excess balls are dispensed.

Another ball counter can dispense a prescribed number of pachinko balls: for example, 100, 400, or 25 balls, but cannot dispense a desired number of balls. In this case, if the ten teeth sprocket is provided stopers every five teeth, pachinko balls are able to be dispensed as a unit of five balls; 25 pachinko balls are dispensed by twe times and halh rotations of the sprocket; 100 pachinko balls are dispensed by ten times rotations of the sprocket, and 400 balls are dispensed by forty times rotations of the sprocket, but it is impossible to dispense eleven balls, thirteen balls, etc., such as prize balls of pachinko.

In view of foregoing, it is the object of this invention to provide a game apparatus having only one pachinko ball dispenser, which dispenses pachinko balls efficiently and inexpensive to manufacture.

It is another object of the present invention to provide a pachinko ball dispenser which dispenses the optionally ordered number of pachinko balls accurately and fast.

DISCLOSURE OF THE INVENTION

The point of the present invention to accomplish theforegoing and other objects are as follows.

A game apparatus (10) comprising a rental ball dispensing unit (30) for instructing the dispense of pachnko balls equivalent to an amount of money put into a slot of the dispensing unit by a player, a game machine (40) using pachinko balls as game medium, and a controller (50) for controlling the rental ball dispensing unit (30) and the game machine (40) collectively, wherein said rental ball dispenser (30) having a money identification means (31) identifying an amount of money put into the dispensing unit and feeding a money sinal or ball signal equivalent to the amount of the money to the controller, said game machine (40) having a pachinko ball dispenser (101) receiving signals: a rental signal, corresponding to the money signal from the money identification means (31), transmitted from said controller (50) and a prize signal transmitted from said controller (50) under prescribed rules, and dispensing pachinko balls into a ball tray (11) with counting the amount of the pachinko balls corresponding to said signals.

The game machine, including an overflow sensor (70) for detecting the ball tray of the game machine being filled with the pachinko balls dispensed from said pachinko ball dispenser (101) and for stopping dispense of pachinko balls with the pachinko ball dispenser via the controller after feeding a fixed amount detected signal to the controller, and a gained pachinko ball display section. (80) for indicating the amount of left pachinko balls after subtracting the number of dispensed pachinko balls, from the dispenser (101) into said ball tray (11), from the total number of dispense pachinko balls.

A game machine (10) including a recording media issuing machine (90) for recording the number of player's all keeping balls or the sum of pachinko balls indicated with said gained pachinko ball display section (80) and the pachinko balls in said ball tray on a recording medium, and for giving the recorded recording medium to the player.

A game apparatus (10), in which said game machine (40) is supplied with pachinko balls by a supply gutter (1) mounted in an game machine island, and said supply gutter (1) and said pachinko ball dispenser (101) is connected with pipes (3, 4).

A method of dispensing the ordered number of pachinko balls by means of a dispenser, the dispenser comprising a sprocket (110) formed plural concave portions (110*a*) in its periphery, each concave portion catching one pachinko ball, mounted rotatably so the concave portions as to face the interior of a pachinko ball passage (171), comprising the steps of: rotating said sprocket (110) by pachinko balls dropping with the gravity consecutively, for continuous ball dispense, until the number of dispensed balls has reached nearly the ordered number of pachinko balls; changing, after the number of dispensed balls reaches the ordered number, the consecutive rotation of the sprocket to an intermittent rotation repeating an little angle rotation correspond to one movement of said concave portion and stop of the rotation; and stopping the intermittent rotation of the sprocket at the time the number of dispensed balls reaches the ordered number of pachinko balls.

A pachinko ball dispenser dispensing the prescribed number of pachinko balls comprising a sprocket formed plural concave portions in its periphery (110*a*), mounted rotatably so the concave portionsin as to the interior of the pachinko ball passage for catching pachinko balls dropping with the gravity one by one by each concave portion with surely rotation of the sprocket, including:

a ratchet wheel (120), coupled with said sprocket, rotating with linking with the sprocket;

a main stopper (130), mounted movably on the side part of the ratchet wheel, for stopping rotation of the sprocket by moving one direction and engaging its one end with a tooth of the ratchet wheel;

a main operating means (150, 132) for moving said main stopper;

a sub-stopper (140), moving with linking with said main stopper as far as not to be pressed by over prescribed external force, for rotating said sprocket only at an angle corresponding to a half movement of said cocave portion by engaging one end of the sub-stopper with said tooth of the ratchet wheel if the main stopper disengaging from the ratchet wheel by moving the other direction;

a sub-operating means (160, 161) for moving said sub-stopper to the direction disengaging the sub-stoper from the ratchet wheel by pressing the sub-sutopper by external force over said prescrived force without the movement of said main stoper;

a dispense detecting means for detecting and counting pachinko balls dispensed from the lower portion of said pachinko ball passage;

a controller for maintaining disengaged state of said main stopper and sub-stopper from said sprocket by cntrolling the action of said main operating means and sub-operating means until the number of detected dispensed balls reaching nearly the ordered number of pachinko balls, and for engaging the main stopper and/or the sub-stopper with the sprocket alternately by operating only the main operating means intermittently, after the number of dispensed balls reaching the ordered number of pachinko balls, until the number of detected dispensed balls being in the same number of the ordered.

The above-mentioned pachinko ball dispenser, in which said main operating means and/or said sub-operating means comprises a solenoid (150, 160), and said controller has a drive circuit (190), which applies an exciting voltage to said solenoide for operating said main stopper and/or said sub-stopper, for applying the exciting voltage larger than a holding voltage of said solenoid for prescribed time just after begining of the driving and applying the holding voltage of said solenoid as the exciting voltage after passing said prescribed time.

The dispense of the pachinko balls from the dispenser (101) is done in accordance with the signals of the controller (50): when the pachinko ball dispenser (101) recieves a rental signal from the controller (50), it counts the number of pachinko balls correspond to the rental signal and dispenses the balls into the ball tray (11).

The number of dispensed balls from the dispenser (101) corresponds to each signal can be set up optionally by the controller (50); for example, if the money signal from said money identification means (31) of the rental ball dispensing unit (30) is equivarent to 1000 yen, 250 pachinko balls are dispensed, if the money signal is equivarent to 500 yen, 125 pachinko balls are dispensed, if the money signal is equivarent to 100 yen, 25 pachinko balls are dispensed. And the number of dispensed balls from the dispenser (101) corresponds to the prize signal, generated under prescribed rules by the controller, can be set up optionally corresponding to the results of game such as 5, 10, 11, 13, 15, 20, etc.

In the method of dispensing the pachinko balls, said sprocket (110) is rotated consecutively for continuous ball dispensing by the pachinko balls dropping with the gravity until the number of dispensed balls reaches nearly the ordered number, and after the reaching, the sprocket rotation is changed from the consecutive rotation to the intermittent rotation for dispensing a pachinko ball one by one; therefore, the dispensing of the excess balls caused to late stopping of the sprocket rotation is prevented.

Furthermore, the ordered correct number of pachinko balls can be dispensed and most of pachinko balls are dispensed fast by the rapid rotating of the sprocket; therefore, whole dispensing time can be shortened.

According to the pachinko ball dispenser of this invention, pachinko balls being dispensed are detected and counted by a dispense detecting means (183), a disengaged state between said main stopper (130) and said ratchet wheel (120), and between said sub-sutopper (140) and the ratchet wheel are holded, until the counted number of dispensed balls reaches nearly the ordered number, by controlling said operating means and sub-operating means with said controller. Thus the sprocket continues rapid rotation by falling of the pachinko balls; therefore, the pachinko balls are dispensed rapidly and continuously until the number of dispensed balls reaches near the operated number.

Then reaching the number of dispensed balls near the operated number, only said main operating means acts intermittently to engage alternately said main stopper and/or sub-stopper with said sprocket. Then, every time the main stopper disengages from the sprocket, the sub-stopper permits the sprocket to rotate about the movement corresponding to the half of the concave portion and engages with the sprocket. In the same way, when the sub-stopper disengages from the sprocket, the main stopper permits the sprocket to rotate about the movement corresponding to the half of the concave portion and engages with the sprocket. In this way every time one cycle of the intermittent operation has done, the sprocket rotates about the movement corresponding to one concave portion, and one pachinko ball is dispensed.

Then if the number of dispensed balls reaches the ordered number, the intermittent operation is stopped (being kept in the state that the main stopper or the sub-stoper is engaged with the sprocket), and the rotation of the sprocket (the dispense of the pachinko balls) is stopped. According to the pachinko ball dispenser of this invention, therefore, said dispensing method of this invention is carried out and the fast and accurate automatic dispense of the patchinko balls is permitted.

One pachinko ball dispenser (101) can count and dispense the pachinko balls renting to players by the rental ball dispensing unit (30) and the prize balls which are dispensed under prescribed rules; therefore, the rental ball dispensing unit (30) and the game machine do not need to have individually a pachinko ball dispenser and/or means for supplying pachinko balls.

In the case that an overflow sensor (70) is mounted on the game machine, the balls not held in a ball tray (11) are detected by the overflow senser (70). This overflow senser (70) feeds a fixed amount detected signal to the controller (50) when it detects the ball tray (11) of the game machine being filled with the pachinko balls, and stops dispense of pachinko balls from the pachinko ball dispenser (101) via the controller (50).

When the pachinko ball dispenser (101) is stopped by the oveflow of the balls, a gained pachinko ball display section (80) indicats (for example with a digital indication, etc.) the amount of left pachinko balls after subtracting the number of dispensed pachinko balls, from the dispenser into said ball tray (11), from the total number of dispense pachinko balls. An excess pachinko ball flow, thereby, is prevented.

In the case that the game machine is equipped with a recording media issuing machine (90), the recording media issuing machine (90) records the all number of player's keeping balls or the sum of pachinko balls indicated with said gained pachinko ball display section and the pachinko balls in said ball tray on a recording medium, and gives the recorded recording medium to the player. The players, thereby, don't need to carry the pachinko balls about with them.

In the case that the supply gutter, mounted in the game machine island, supplies the pachinko balls to the game machine (40), a ball tray, a supply ball counter and so which are mounted the upper back of the prior game machine (40) are unnecessary, and an amount of work is reduced by connecting the supply gutter (1) with the pachinko ball dispenser (101) by means of a pipe means.

BEST MODES FOR CARRYING OUT THE INVENTION

One of the embodiments of the present invention will now be described in detail with reference to drawings, FIGS. 1–13.

Figure 1:
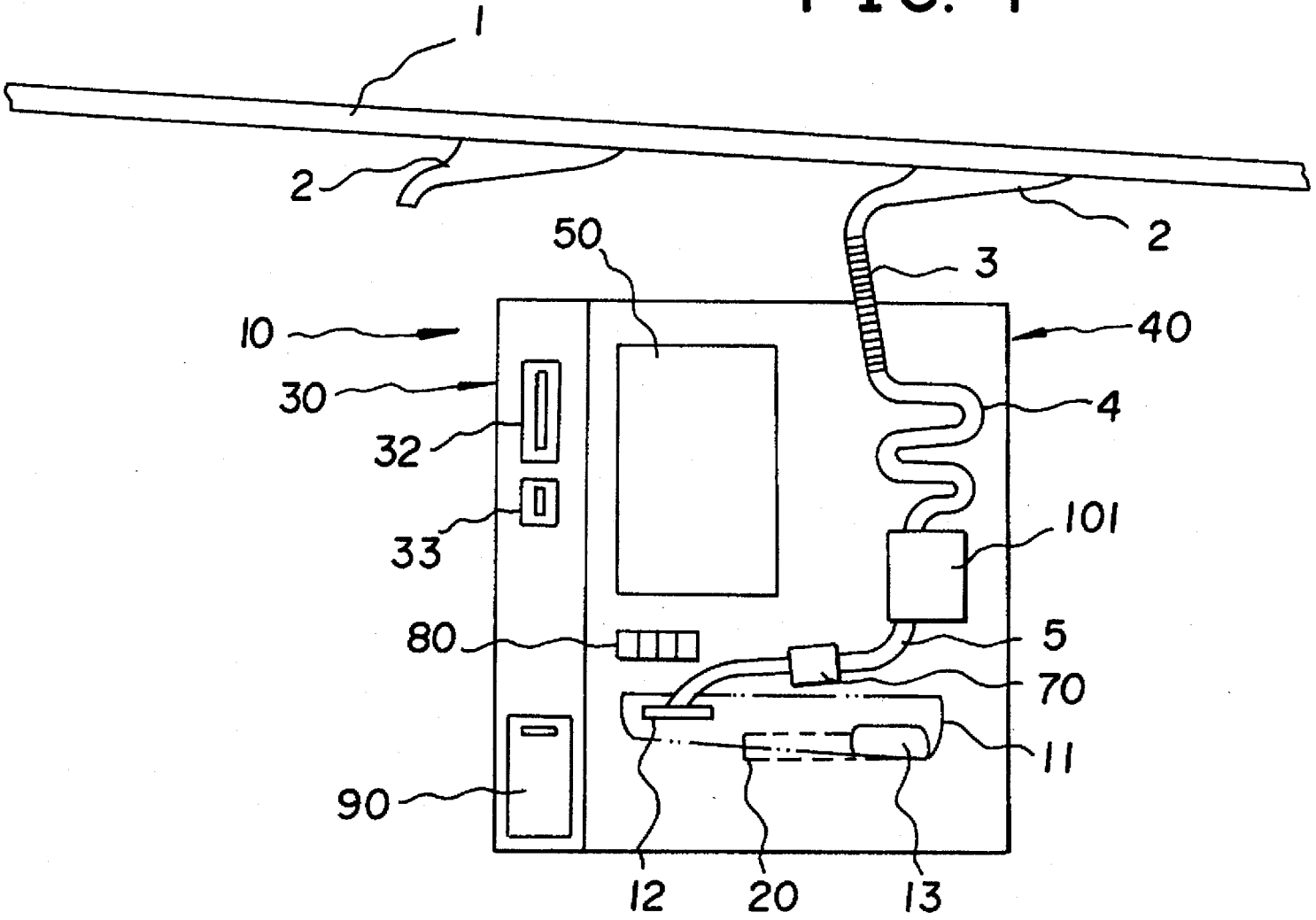
FIG. 1 is a schematic elevation view of a game machine of an embodiment of the present invention.
Figure 2:
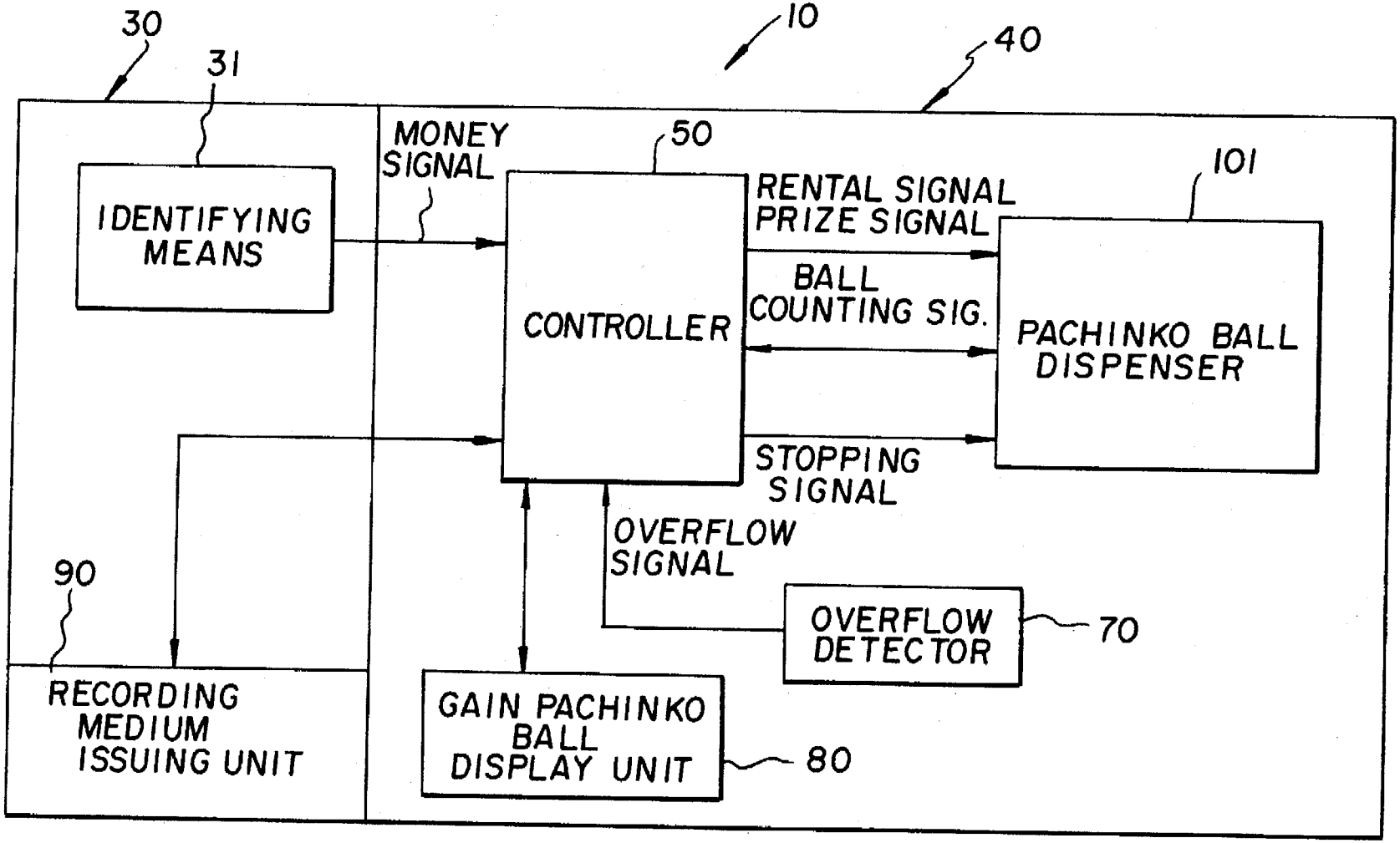
FIG. 2 is a block diagram showing a game machine of an embodiment of the present invention.

A game machine 10 of the present invention, as shown in FIG. 1 and FIG. 2, comprises: a rental ball dispensing unit 30 which indicates dispensing of the pachinko balls equivalent to the amount of the money put into the dispensing unit by a player; a game machine 40 using pachinko balls as game medium such as a slot machine using a pachinko ball; and a controller 50 which controls centrally the rental ball dispensing unit 30 and the game machine 40. The rental ball dispensing unit 30 and the game machine 40 are separate units in the present embodiment, however, they may be constructed one.

In the front face of the rental ball dispensing unit 30, a paper money slot 32 and/or a coin slot 33 into which player put moneys and/or coins. And the rental ball dispensing unit 30 has a identifying means 31 which identifies the amount of the money put into the paper money slot 32 and/or the coin slot 33 and feeds a money sinal equivalent to said amount of the money to the controller 50.

Concretely speaking, the identifying means 31 is connected to the controler 50 so as to feed the money signals to the controller 50; the money signals order the dispense of 25 pachinko balls when 100 yen is put into the rental ball dispensing unit 30, the dispense of 125 balls for 500 yen and 250 balls for 1000 yen.

The controller 50 is connected to a pachinko ball dispenser 101 so as to feed rental signals which order the dispense of the prescribed number of the pachinko balls (25 balls for 100 yen, 125 balls for 500 yen and 250 balls for 1000 yen) corresponding to the money signals from the identifying means 31 of the rental ball dispensing unit 30 to said pachinko ball dispenser 101.

The controller 50 also set up to feed a prize signal, under prescribed rules of the game machine 40, to the dispenser 101 and it to dispense the prescribed number of the prize balls.

The game machine 40 is supplied with the pachinko balls via a supplying gutter 1 mounted in a game island. A shoot 2 is fixed to the supplying gutter 1 in place, and the shoot 2 and the dispenser 101 are connected with a bellows like pipe means and a zigzag pipe 4 reducing the flowing down speed of the pachinko balls. Thus a tray for reserving pachinko balls is not mounted on an upper portion of the game machine. The rental ball dispensing unit 30 is not supplied with the pachinko balls.

Figure 5:
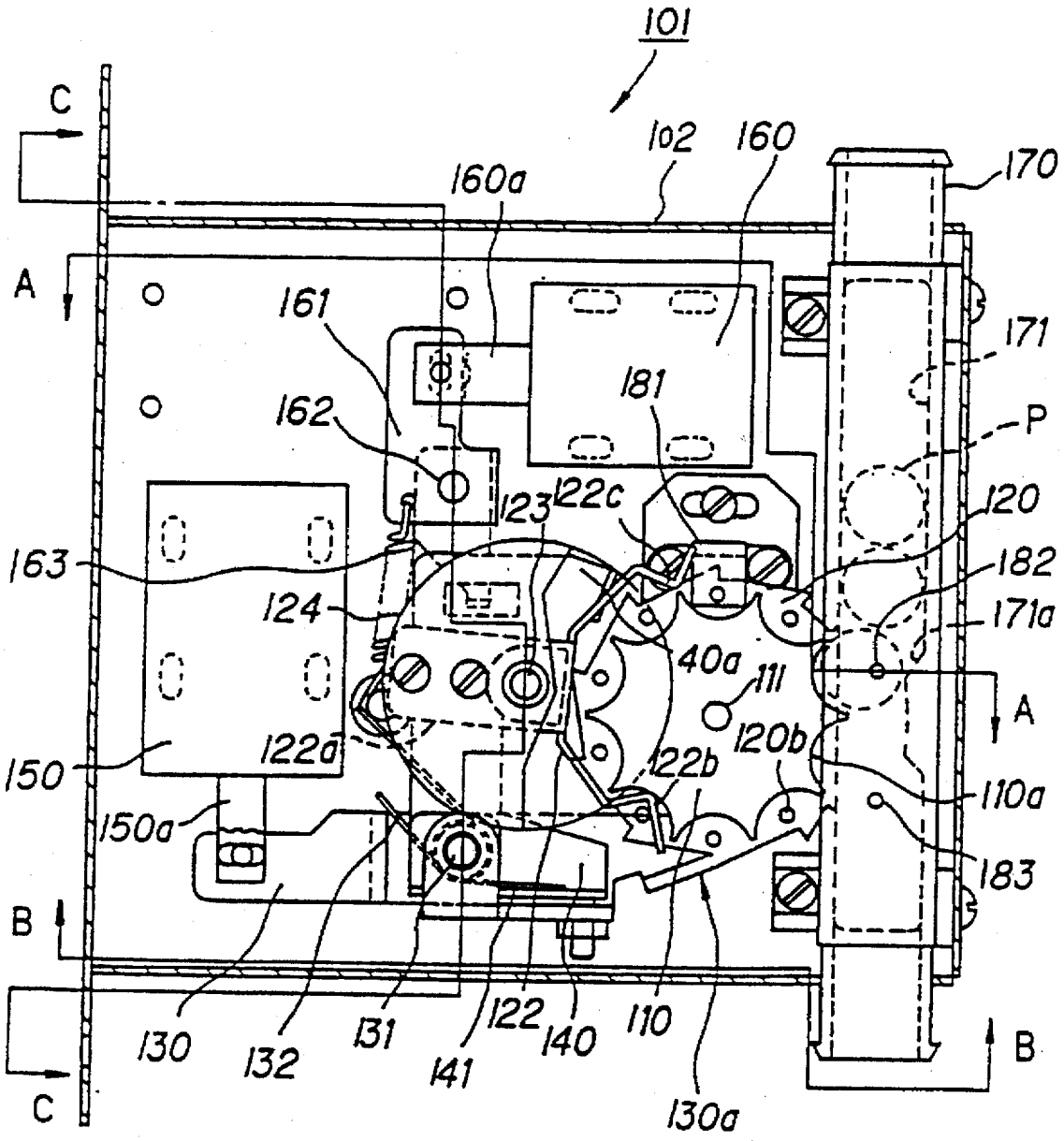
FIG. 5 is a front view showing the construction of a pachinko ball dispenser.
Figure 6:
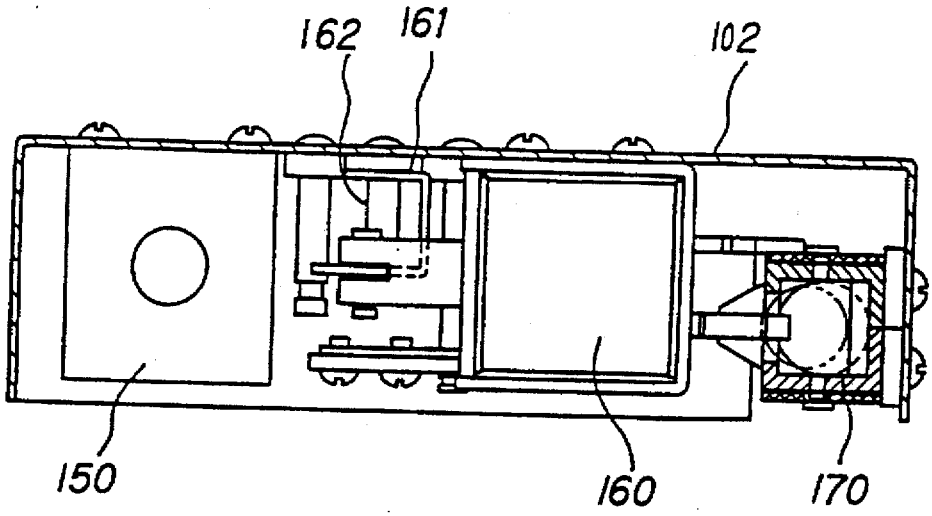
FIG. 6 is a cross sectional view taken along line A—A of FIG. 5.

The pachinko ball dispenser 101 can dispense the optionaly ordered number pachinko balls corectly and fast. Concretely, as shown in FIG. 5, the principal compositions of the dispenser 101 are a sprocket 110 mounted in a frame 102, a ratchet wheel 120, a main stopper 130, a sub-stopper 140, a couple of a main solenoid 150 and a sub-solenoid 160, a ball guide 170 pierced vertically one side of the frame 102, detecting means 181, 182, 183 mounted the inside of tha frame 102 or the ball guide 170, and a controll means (not shown) attached the inside of the frame 102 or separately.

The sprocket 110 is formed ten concave portions 110*a* in its periphery, and it is supported rotatably by a sprocket shaft 111 mounted holizontaly in the frame 102 so as to face the concave portions to the interior of a pachinko ball passage 171 for catching pachinko balls one by one with each concave portion. A cross section of the pachinko ball passage 171 is formed only one pachinko ball to pass the passage 171 remaining a little gap between the ball and the inner wall of the passage 171, and the periphery of the sprocket 110 faces the interior of the passage 171 according to the pasage; therefore, the pachinko ball dropping in the passage 171 from the upstream with gravity is caught in the concave portion 110*a* and the sprocket is surely rotated. Further, at the position near the sproket 110, a slanted section 171*a* protruding inside is provided on an inside wall surface of the passage 171. Where the slanted section 171*a* exists, the pachinko balls take a passage nearer to the sprocket 110 within the passage 171 and fit precisely into the concave portions 110*a*.

Figure 7:
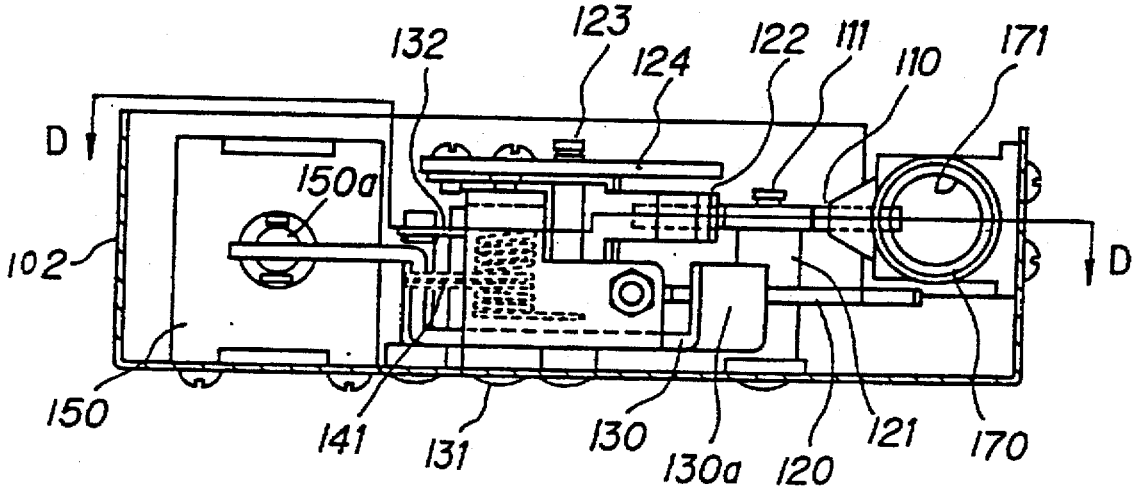
FIG. 7 is a cross sectional view taken along line B—B of FIG. 5.

As shown in FIG. 7, teeth 120*a* of the same number of the concave portions 110*a* of said sprocket 110 are formed on the periphery of the ratchet wheel 120. The ratchet wheel 120 is fixed to the sprocket 110, so as not to interfere with the ball guide 170, by an output shaft 121 being inserted with the shaft of sprocket 110 and is supported by the sprocket shaft 111. Thus, the ratchet wheel 120 and the sprocket 110 are composed to rotate as one. Small holes 120*b* for passing detecting light for the detecting means 181 are provided corresponding to each of cogs at the periphery of the ratchet wheel 120. As shown in FIG. 5, the phase relationship of the ratchet wheel 120 and the sprocket 110 is such that when the main stopper 130 is engaged with the ratchet wheel 120, the tip ends (the jutted out portion between concave portions 110*a*) of the sprocket 110 are positioned on corresponding left and right cogs.

The rotation of the sprocket 110 and the ratchet wheel 120 is controled by a governor 122. The governor 122 is swingably mounted at its base end portion 122*a* to a governor axis 123. From the base end portion 122*a*, engaging pieces 122*b*, 122*c* which are engageable with the concave portions of the sprocket 110 extend to left and right. At a top surface of the base end portion 122*a*, a disc-form weight 124 having a large inertia is provided. The governor 122 swings about a governor axis with the rotation of the sprocket 110; the engaging pice 122*b* and the engaging pice 122*c* engage with the periphery of the sprocket 110 alternately. Therefore, as one pachinko ball passes, the sprocket 110 rotates by an angle of one concave portion 110*a*.

The main stopper 130 is swingably mounted on a stopper axis 131 which is parallel to the shaft 111 of the sprocket 110. The main stopper 130 engages at its tip 130*a* with the ratchet wheel 120 at the underside after turning counterclockwise. The turning is done by the force from a spring 132 wound around the stopper axis 131.

The sub-stopper 140 is fixed to a stopper axis 131 in a condition free to turn. In a position turned clockwise, a tip portion 140*a* engages with the periphery of the ratchet wheel 120. The base end portion of the sub-stopper 140 ia pressed against a bottom of the main stopper 130 by the urging force of a spring 141 wound around the stopper axis 131. Thus, as long as a force not exceeding the urging force of the spring 141 is operated on, the sub-stopper 140 is linked to tha main stopper 130 and turned together in the same direction. As long as the sub-stoper 140 is linked to the main stopper 130, the tip portion 140*a* engages with the ratchet wheel 120 at the left upper portion when the coupling of the main stopper 130 eith the ratchet wheel 120 is released by clockwise turning. In this connection, it is to be noted the accurate timing of the movement is such that the sprocket 110 and the ratchet wheel 120 are allowed to turn by an angle corresponding to half of tha concave portion 110*a* after the engagement with the main stopper 130 is released and before the engagement with the sub-stopper 140 is completed.

The main solenoid 150 has its output axis 150*a* connected to the base end portion of the main stopper 130. When the main solenoid 150 is excited, it works towards the direction where the output axis 150*a* sinks, and turns the main stopper 130 clockwise. When the main solenoid 150 is not driven, the main stopper 130 is restored to the position to engage with the ratchet wheel 120 by the urging force of the spring 132. The main solenoid 150 and the spring 132 constitute the main drive means in the present invention.

Figure 8:
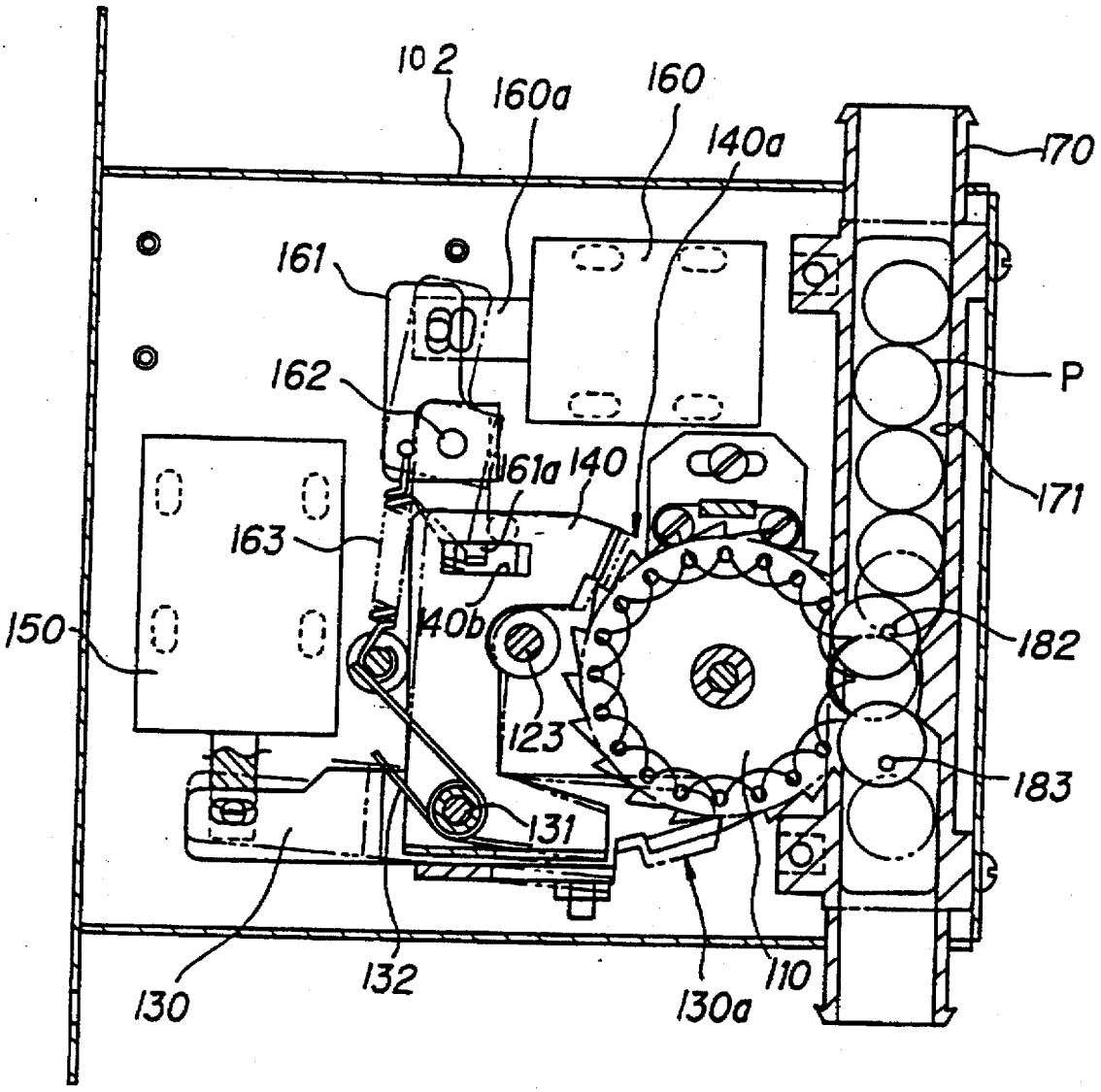
FIG. 8 is a cross sectional view taken along line D—D of FIG. 7.
Figure 9:
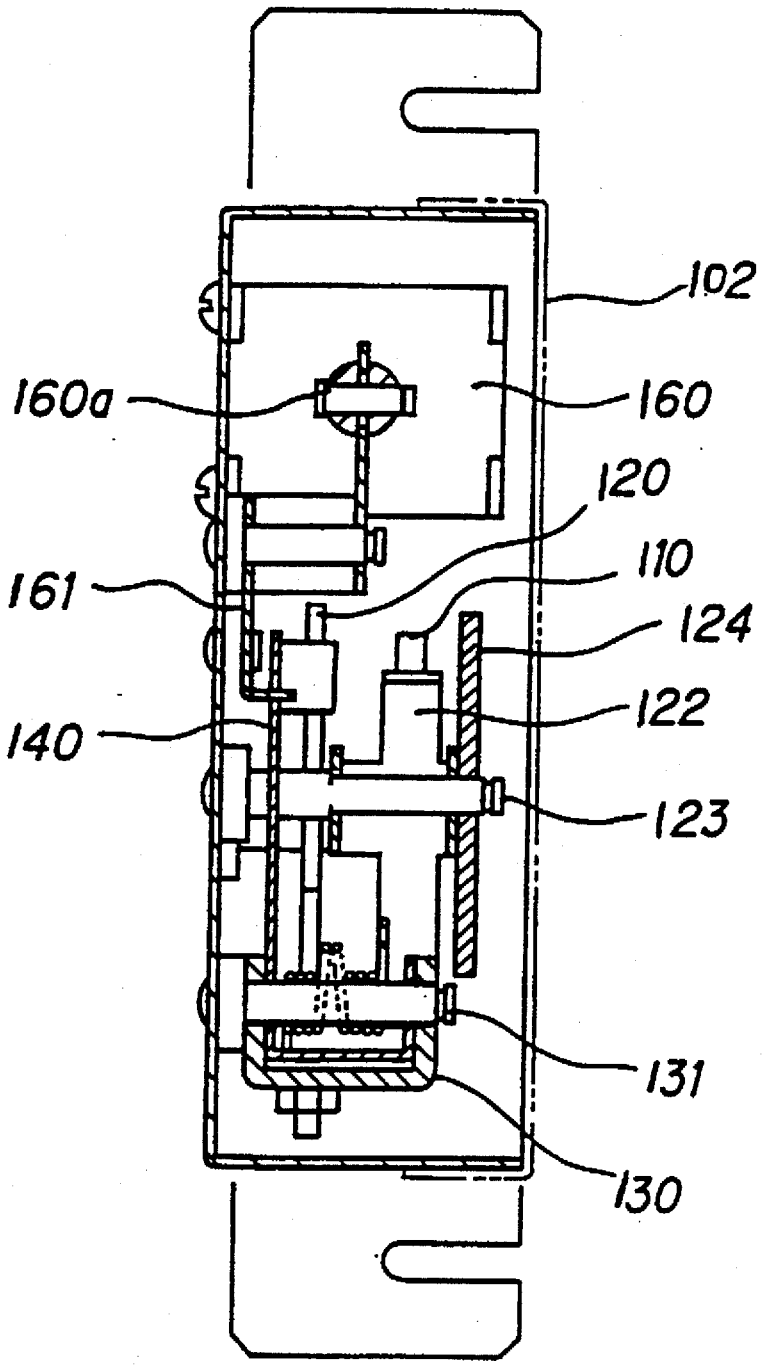
FIG. 9 is a cross sectional view taken along line C—C of FIG. 5.
Figure 10:
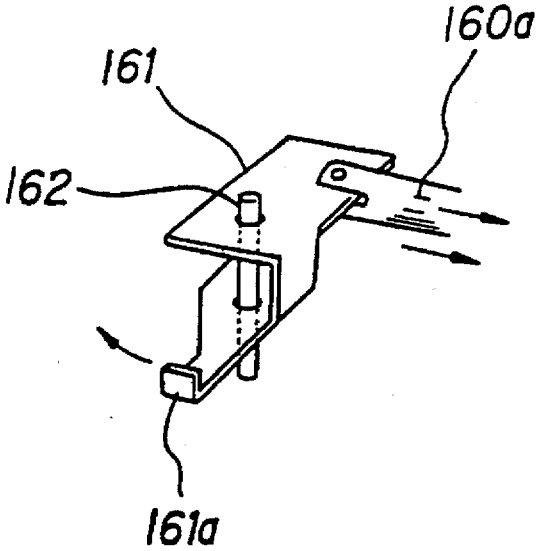
FIG. 10 is an enlarged prespective view showing the fixing condition of a lever.

The sub-solenoid 160 can operate a force exceeding the urging force of the spring 141 on the sub-stopper 140 via the lever 161. Thus, the connection to ratchet wheel 120 can be released by turning the sub-stopper 140 counterclockwise, irrespective of the position of the main stopper 130 at that moment. As shown in FIG. 8, a elongated hole 140*b* is provided in the tip of the sub-sutopper 140, and a click 161*a* provided on the top of the lever 161 is engaged with the elongated hole 140*b*. The lever 161 is rotatably supported about a lever axis 162 and turned when it is pulled by output axis 160*a*. When the sub-solenoid is operated and the lever 161 is turned clockwise, the sub-stopper 140 is turned counterclockwise by the push of said click 161*a*. The spring 163 urges the lever 161 counterclockwise. Therefore, when the drive of the sub-solenoid 160 is released, the lever 161 returns by this urging force to the position not letting the sub-stopper 140 turn. The sub-solenoid 160 and the lever 161 constitute the sub driving means of the present invention.

The detecting means 181, constructed including a photo-electric switch, is for detecting the rotation of one concave portion 110*a* of the sprocket 110. The detecting means 181 detects the rotation of an angle corresponding to one of tha concave portion 110*a* of the sprocket 120 by emmiting detecting light at the position where the small holes 120*b* of the ratchet wheel 120 pass and detecting the light. The detecting means 182, constructed including a photo-electric switch, is for detecting the supplying condition of the pachinko balls. The detecting means 182 detects the supplying condition of the pachinko balls by emitting detecting light at the position just after a pachinko ball is engaged with a concave portion 110*a* of the sprocket 110 and detecting that light. The detecting means 183 is for detecting the dispensing of the pachinko balls. The detecting means 183 is constructed including a luminescent section for emiting detecting light at the position where a pachinko ball is just released from the concave portion 110*a*, and a light receiving section for receiving the light. It constituts a dispensing means of this invention. The detecting means 183 detects accurately the dispense of pachinko balls, however, the number of dispensed balls can be detected indirectly by the detecting means 181.

The control means is for controlling the operation of the main solenoid 150 or sub-solenoid 160. The control means comprises a micro computer etc., and controls the operation of the main solenoid 150 or sub-solenoid 160 according to a flow chart shown in FIG. 13 after receiving the dispensing order or the detection result of the detecting means 183 and so on.

Figure 12:
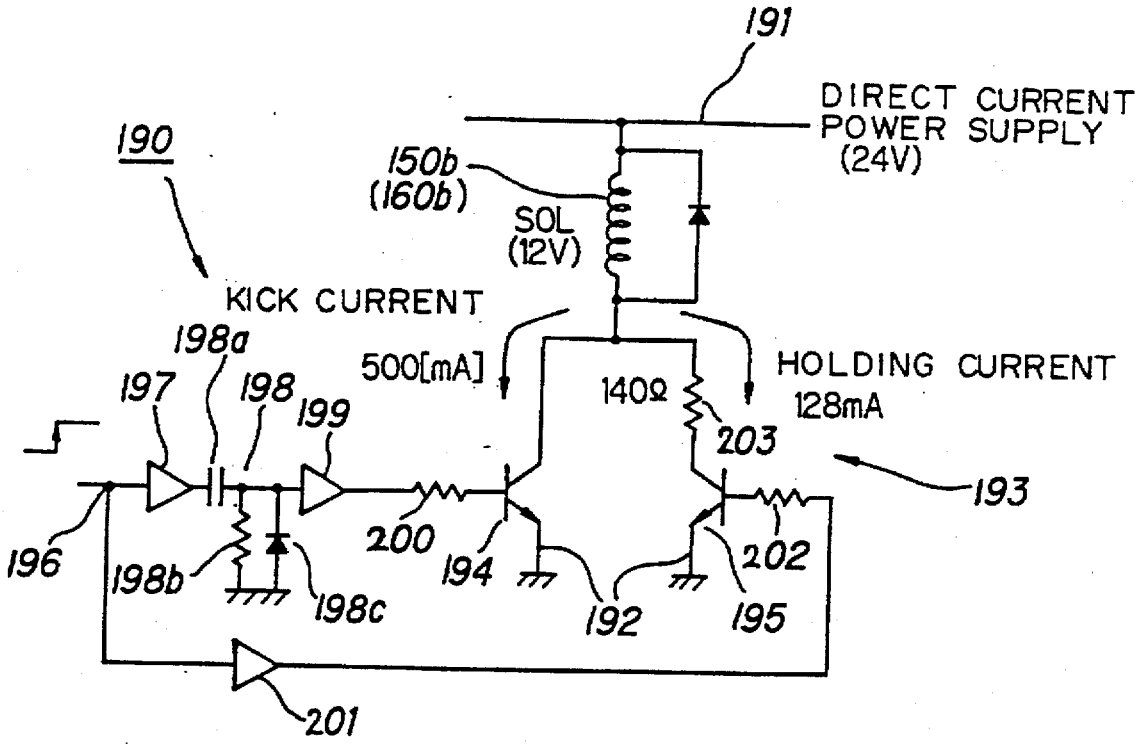
FIG. 12 is a circuit diagram of a pachinko ball dispenser of the present invention.

A drive circuit 190, constructed as shown in FIG. 12, is for actually applying an exciting voltage to each of the main slenoid 150 and the sub-solenoid 160. The drive circuit 190 is constructed such that a coil 150*b* of the main solenoid 150 or a coil 160*b* of the sub-solenoid 160 and a switching circuit 193 are connected in series between a direct current power supply 191 and a ground 192.

The switching circuit 93 is provided with two NPN transistor 194 and 195 connected in parallel. Between the base electrode of the transistor 194 and an input terminal 196, a buffer 197, a differentiating circuit 198, a buffer 199, and a resistance 200 are provided. On the other hand, between the base electrode of the transistor 195 and the input terminal 196, a buffer 201 and a resistance 202 are provided. Further, between the coil 150*b* and a collector electrode of the transistor 195, a resistance 203 is provided.

The input terminal 196 is a terminal where the drive instruction (ON signal) of the main solenoid 150 or sub-solenoid 160 is inputted from the control means. The differentiating circuit 198 is constructed from a capacitor 198*a*, a resistance 198*b*, and a clipping diode 198*c*, and is well known. The differentiating circuit 198 outputs ON after a fixed time has passed from the point where the input terminal 196 became ON. Furthermore, this fixed time is determined according the time constant of the differentiating circuit 198. In the present embodiment, said fixed time made somewhat longer than the time needed for the output axis of the main solenoid 150 or that of the sub-solenoid 160 to move from the yet-to-start position to the starting position. In this case, for example, if the supply voltage of the direct current power supplu is 24V, the resistance of the main solenoid 150 or sub-solenoid 160 is 48Ω, the rated voltage is 12V (the rated current is 250 mA), and the holding voltage is 6.1V (the holding current is 128 mA), then resistance 203 may be 140Ω.

The ball guide 170 of the pachinko ball dispenser 101, as shown in FIG. 1, is connected to a prize ball dispensing port 12 of the tray 11 via a pipe means 5 such as bellows.

An overflow detector 70 is set in the middle of the pipe means 5 which connects the tray 11 to the pachinko ball dispenser 101. As the overflow detector 70 detects the tray being filled with the pachinko balls dispensed from the pachinko ball dispenser 101, it feeds a fixed amount detected signal to the controller 50. Then the controller 50 stops the pachinko ball dispensing by the pachinko ball dispenser 101.

The overflow detector 70 includes a sensor which detects the pachinko balls jammed into the pipe means 5, not being dispensed from the prize ball dispense port 12, when the tray 11 is filled with the balls. The overflow detector 70 is connected to the controller 50 for feeding an overflow signal to it when the balls are jammed into the pipe means 5. When the controller 50 recieves the overflow signal from the overflow detector 70, it feeds a stopping signal to the pachinko ball dispenser 101 for stopping the act of the dispenser 101 at once.

Figure 3:
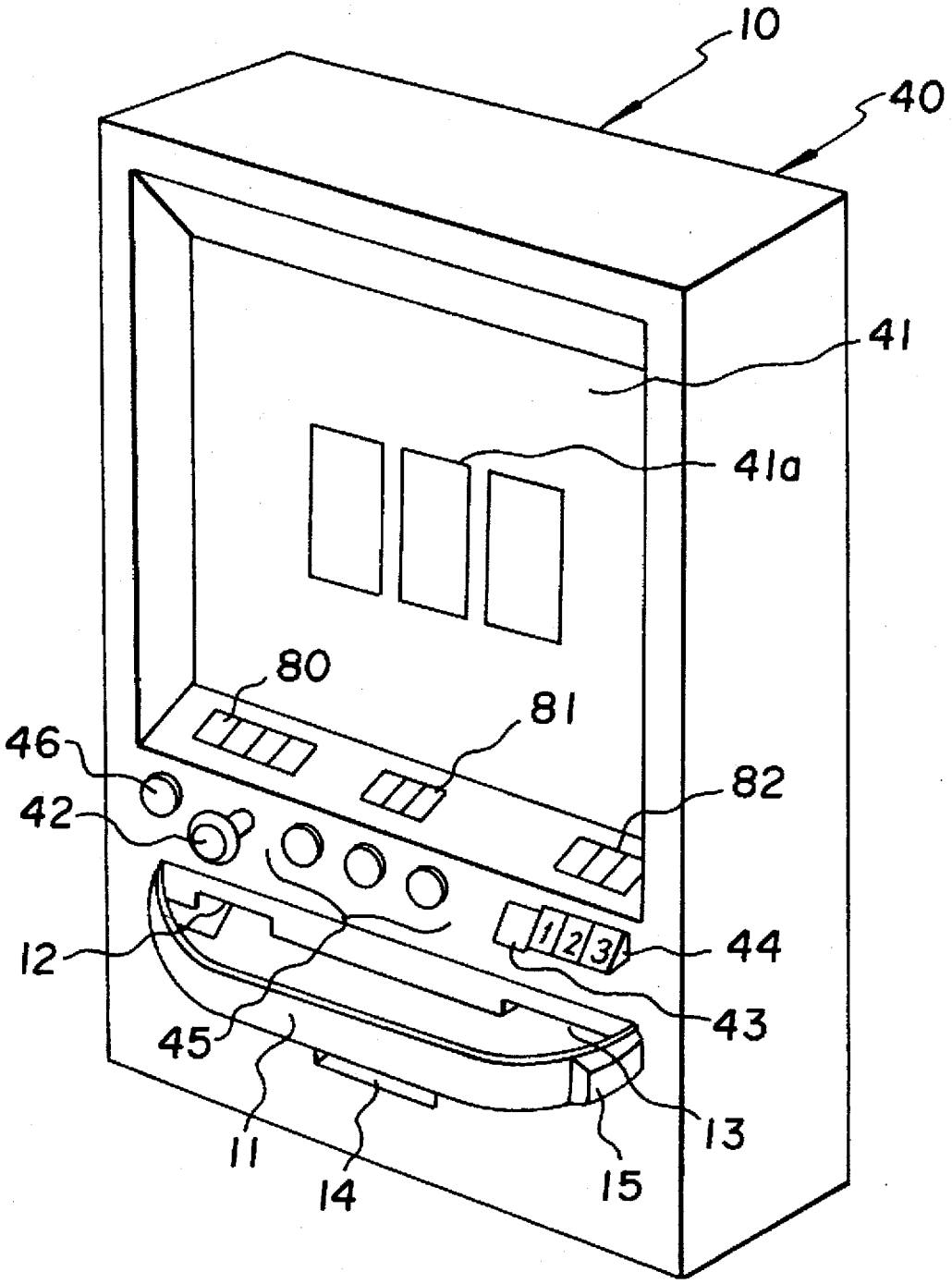
FIG. 3 is a perspective view of a game machine of an embodiment of the present invention.
Figure 4:
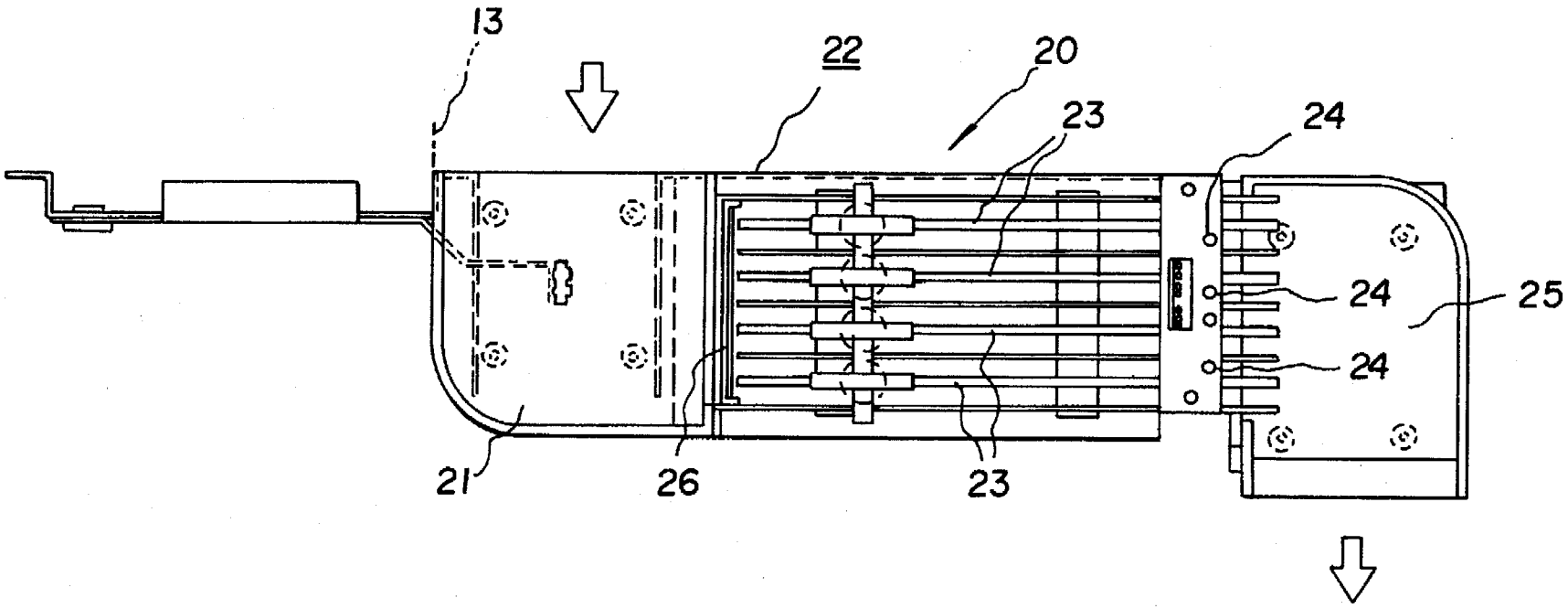
FIG. 4 is a plan view of a inserted ball counter (comprising four counters) built in a game machine of an embodiment of the present invention.

As shown in FIG. 1–FIG. 3, a gained pachinko ball display section 80 is mounted on the front portion of the game machine 40. When the dispensing of the dispenser 101 is stopped, the gained pachinko ball display section 80 indicates, according to the order from the controller 50, the amount of left pachinko balls after subtracting the number of dispensed pachinko balls, from the dispenser into said tray, from the total number of dispense pachinko balls. The gained pachinko ball display section 80 consists of seven segments LED for digital indicating of said amount of left pachinko balls.

There is two system for indicating the amount of left pachinko balls as the tray 11 is filled with the balls; one indicates the counted left balles at once, the other indicates the left balls one by one with counting up them. For example, in the case of dispensing 250 pachinko balls into the tray 11 by the pachinko ball dispenser 101, if the overflow detector 70 detects the pachinko balls jammed into the pipe means 5 at the moment when 183 balls have dispensed, left 67 balls are indicated in the former system. On the other hand, in the later system, the tray 11 is supplied with balls additionaly if the balls in the tray decrease during the indicating of the left balls with counting up them one by one; therefore, the final number indicated with the gained pachinko ball display section 80 is sometimes smaller than 67.

In a gaming face 41, as shown in FIG. 3, variable display sections 41*a* which indicate many kinds of pattarns are mounted. Pattarns being indicated in the variable display sections 41*a* bigin change by pushing a starting lever 42. Pattarns changing of each variable display sections 41*a* can be stopped individually with stopping switches 45 corresponding to each display section.

The game machine 40 is set that the controller 50 receives the prize balls dispense order according to the prescribed dispense rate (the rules of game) if prescribed combination of the patterns being indicated on said each variable display sections 41*a* according to prescribed rules are lined on some win lines by stopping the changing patterns of the display sections with stoping switches 45. The controller 50 is set to feed a prize signal, according to the prescribed dispense rate, to the pachinko ball dispenser 101. A prize ball display section 81 which indicates the number of the prize balls dispensed from the pachinko ball dispenser 101 is provided in the lower portion of the gaming face 41.

Furthermore, the game machine 40, at its front side, comprises a ball inserting switch 44 for inserting pachinko balls from a ball inserting port 13, provided in the tray 11, to the inside of the game machine 40, and an inserted ball number display section 82 for displaying the inserted ball number.

At the inner side of the ball inserting port 13 of the tray 11, an inserted ball counting means (four counters) 20 for quick counting of the inserted balls into the inside of the game machine 40 is provided. The inserted bal counting means comprises a take-in stage 21, an introduction path 22 whose starting end is connected to the take-in stage 21, a line up rails 23, 23 . . . set in paralel in four lines in the introduction path 22, inserted ball detecting sensors 24 provided at the terminating end of each line up rail 23, and a dispensing stage 35 connected to the terminating end of the introduction path 22.

A shutter member 26 is provided between an exit of the take-in stage 21 and the starting end of the introduction path 22. The shutter member 26 is driven by a rotary solenoid (not shown in the drawinds), and is constructed in such a way that it is able to open and shut. When the shutter member 26 is shut, the pachinko balls within the take-in stage 21 cannot flow into the introduction path 22.

As shown in FIG. 1 and FIG. 2, a recording medium issuing unit 90 is provied at the lower portion of the rental ball dispensing unit 30. When a calculating switch 46 (shown in FIG. 3) is pushed to finish the game, the recording medium issuing unit 90 receives the signal from the controller 50, and records the number of player's all keeping balls or the sum of pachinko balls indicated with said gained pachinko ball display section 80 and the pachinko balls in said tray 11 on a recording medium such as card or sheet and so on, and issues the recorded recording medium to the player. Then the pachinko balls in the tray 11 is counted by the inserted ball counting means 20.

The summary of the operation of the embodiment will be explained next.

When the money is put into the rental ball dispensing unit 30 coupled with the game machine 40, the money signal equivalent to the amount of the money is feeded to the controller 50. When 100 yen is put into the rental ball dispensing unit 30, the money signal ordering 25 balls dispense is feeded to the controller 50. If the money is 500 yen, the money sinal is one ordering 125 balls dispense. For 1000 yen the money signal is one ordering 250 balls dispense.

When the controller 50 receives the money signal from the identifying means 31 of the rental ball dispensing unit 30, the controller 50 feeds the rental signal which orders the dispense of the prescribed number of the pachinko balls corresponding to the money signals to the ball counting means 60, and then the pachinko ball dispenser 101 dispenses the prescribed number of pachinko balls. The number of tha pachinko balls dispensed from the dispenser 101 according to the money signal is able to set optionally by the controller 50.

The overflow detector 70, as shown in FIG. 1 is set in the middle of the pipe means 5 which connects the prize ball dispense port 12 of the tray 11 to the pachinko ball dispenser 101. Although 250 balls are dispensed from the dispenser 101 when 1000 yen is put into the rental ball dispensing unit 30, all balls cannot go in the tray 11. In such a case, the pipe means 5 is jammed with the balls that cannot go in the tray 11. The overflow detector 70 detects the balls stopped in the pipe means 5, and feeds the overflow signal to the controller 50. Then the controller 50 feeds the stopping signal to the pachinko ball dispenser 101, and the dispenser 101 stops the dispensing of the balls.

As the dispensing of the balls from the dispenser 101 stops, the gained pachinko ball display section 80 indicates, according to the order from the controller 50, the amount of left pachinko balls after subtracting the number of dispensed pachinko balls, from the dispenser into said tray, from the total number of dispense pachinko balls.

As the system for indicating the number of the left balls, there is two methods; one indicates the counted left balles at once, the other indicates the left balls one by one with counting up them.

The pachinko balls put into the tray 11 go on top of the take-in stage 21 of the inserted ball counting means 20 provided at the inner side of the ball tray 11, and are held there by the shutter member 26. When the player turns the ball inserting switch 43 to ON, to start the game, the controller 50 operates the rotary solenoid (not shown in the figures) to open the shutter member 26. Then, the pachinko balls held on the take-in stage 21 until then will flow along the line up rails 23. The inserted ball detecting sensor 24 detects the pachinko balls inserted in this way and outputs to the controller 50. After adding to this the number of the pachinko balls that have been inserted but not yet used in the game, the controller 50 digitally displays this calculated result on the inserted ball number display section 82. The pachinko balls counted by the inserted ball counting means 20 will then flow into a gutter for collecting via the stage 25 and a dumper for deceleration.

After inserting a desired number of pachinko balls into the game machine 40, the player turns the ball inserting switch 43 to Off. Then, the controller 50 closes the shutter member 26 and stops the take in of the balls from the take-in stage 21. Then the player operates either one of the selecting switches 44. Then, the value to be displayed on the inserted ball number display section 82 is changed to the values where the taken-in number is subtracted. For example, when one of the selecting switch 44, "1", is pressed, the take in number is 5, and the value displayed on the inserted ball number display section 82 will be less by 5. When another selecting switch 44, "2" is pressed, the take in number is 10, and the value displayed on the inserted ball number display section 82 will be less by 10. Further, if the other selecting switch 44, "3", is pressed, the take in number is 15, and the value displayed on the inserted ball number display section 82 will be less by 15.

The gaming lines are decided by the selected taken-in number in accordance with the prescribed rules, and the lines are displayed on the gaming face 41. When the starting lever 42 is operated in this condition, controller 50 starts the changing patterns of the variable display sections 41*a*, and then they will stop individually by pushing stoping switches 45 one by one. After the changing has stopped, the controller 50 determines the number of the prize balls in accordance with the patterns alined on the gaming lines and outputs the prize signal to the pachinko ball dispenser 101 for dispensing the prize balls. The pachinko ball dispenser 101 will dispense the determined number of the prize balls to the tray 11 in accordance with the prize signal.

Thus, the pachinko ball dispenser 101 can count and dispense both the rental balls to be rented for the player by the rental ball dispensing unit 30 and the pachinko balls in accordance with the prescribed rules as the prize balls;

therefore, there is no need to mount individually the means for supplying pachinko balls and the pachinko ball dispenser 101 to the rental ball dispensing unit 30 and the game machine 40.

When the tray 11 is filled with the prize balls, the overflow detector 70 detects the condition of the tray 11 and the pachinko ball dispenser 101 stops ball dispensing. The number of undispensed balls are added to the indicated number of the gained pachinko ball display section 80. At the same time, the number of dispensed prize balls are indicated by the prize ball display section 81. Thus, this embodiment can prevent the excess pachinko balls flowing and decrease an accident such as pachinko ball jamming; therefore, the present embodiment can dispense the pachinko balls efficiently and players can enjoy the game without interruptions.

When the inserted ball number indicated by the inserted ball number display section 82 becomes zero or under the number needed for the one gamming, the player cannot to play game. In this case, if the player inserts the pachinko balls in the tray 11 into the inside of the game machine 40 by pushing the ball inserting switches 43, the inserted ball counting means 20 counts the inserted balls and the number of the balls is indicated by the inserted ball number display section 82, and he can resume the game.

If the tray 11 emptied, the player cannot continue the game. But in the case that the number of the balls are indicated by the inserted ball number display section 82, the player can play the game. Three method for continuing the game in above case are explained hereinafter.

In first method, a detecting means (not shown) for detecting pachinko balls in the tray 11 is mounted on the tray 11. When the tray emptys, an empty signal is feeded to the controller 50, and the controller 50 outputs a supplying signal to the pachinko ball dispenser 101. And then, the pachinko ball dispenser 101 starts the dispensing balls. The balls for supplying are dispensed until the indicated number on the gained pachinko ball display section 80 becomes zero. The balls are counted one by one and the indicated number is decreased by the just number of the dispensed balls.

Thus, if the tray 11 empties, it is automatically supplied with pachinko balls, and a player can continue the game. If the tray 11 is filled with the dispensed pachinko balles in the halfway of dispensing and the overflow detector 70 detects the condition of the tray 11, the dispensing of the balls into the tray 11 is stopped. Therefore, at the same time, the subtracting indication of the gained pachinko ball display section 80 stops.

In second method, if the player makes next operation for playing the game, the indicated number on the gained pachinko ball display section 80 decreases at a constant speed with keeping the tray 11 empty. And the decreased number is added to the indicated number on the inserted ball number display section 82. Therefore, the player can continue playing the game, and if the prize balls are dispensed and the player pushes the ball inserting switch 43, the pachinko balls are inserted and the number of them counted by the inserted ball counting means 20 is added to the indication on the inserted ball number display section 82.

One method for detecting the balls in the tray 11 is such one in the first method mentioned above, and it needs the tray 11 having the detecting means. In another method for detecting the balls in the tray 11, the game machine is equipped with a timer (not shown). If no balls are counted by the inserted ball counting means 20 within a prescribed time after pushing the ball inserting switch 43, the indicated number on the gained pachinko ball display section 80 is decreased automatically and the decreased number is added to the indicated number on the inserted ball number display section 82.

In third method, as the detecting overflowed balls by the overflow detector 70 are stopped with the decreasing balls in the tray 11, the tray 11 is supplied with the pachinko balls until the indicated number on the gained pachinko ball display section 80 is decreased to zero. Then, the decreased number is added to the indicated number on the inserted ball number display section 82.

When a player moves from the game machine in gaming to another game machine or wants exchange of his gained balls for pachinko prizes, he finish playing game. If he wants to move the game machine in gaming to another game machine, he need to position a ball container below a pchinko ball dispensing port 14 under the ball tray 11. Then, if he operates a ball dispensing lever 15, the take-in stage 21 drops toward the ball tray 11; therefore, all the balls on the stage 21 and in the ball tray 11 drop into the ball container through the pchinko ball dispensing port 14.

If the ball tray 11 is empty and the indicated number on the gained pachinko ball display section 80 is not zero, the pachinko ball dispenser 101 dispenses balls into the ball tray 11, with detecting the balls in the ball tray 11 by the detecting means fixed in the ball tray 11, until the indicated number on the gained pachinko ball display section 80 decreases to zero. The balls dispensed into the ball tray 11 drop into the ball container, thus all the gained pachinko balls can be moved into the ball container. The player can start game at another game machine carrying the container to the game machine.

On the other hand, when the player wants exchange of his gained balls for pachinko prizes, he needs to push the calculating switch 46 below the game face 41. If the calculating switch 46 is pushed, the shutter 26 of the inserted ball counting means 20 will open and the pachinko balls in the ball tray 11 flow to the line up rails 23. The pachinko balls flows into the dispensing stage 25 after being counted by the inserted ball detecting sensor 24, and then they flow into the gutter for collecting.

The controller 50 adds the number of the counted balls to the indicated number on the gained pachinko ball display section 80. After counting and indicating the ball have been finished, the controller 50 adds the indicated number on the inserted ball number display section 82 to the indicated number on the gained pachinko ball display section 80 and returns the indicated number on the inserted ball number display section 82 to zero. Then the controller 50 feeds signals to the recording medium issuing unit 90, and the unit 90 records necessary data such as the all gained balls of the player at the finish of game in a recording medium such as a card or a receipt and issues the recording medium to the player. The player can exchange it for the pachinko prize at a exchanging corner. Thus, the player needs not carry the pachinko balls.

The summary of the operation of the pachinko ball dispenser will explained next.

When the main solenoid 150 and sub-solenoid 160 are not driven, as shown in FIG. 5, the main stopper 130 is restored to the position to engage with the ratchet wheel 120 by the urging force of the spring 132; therefore, the sprocket 110 is maintained in an inoperative state and the pachinko balls will not be dispensed.

Figure 11:
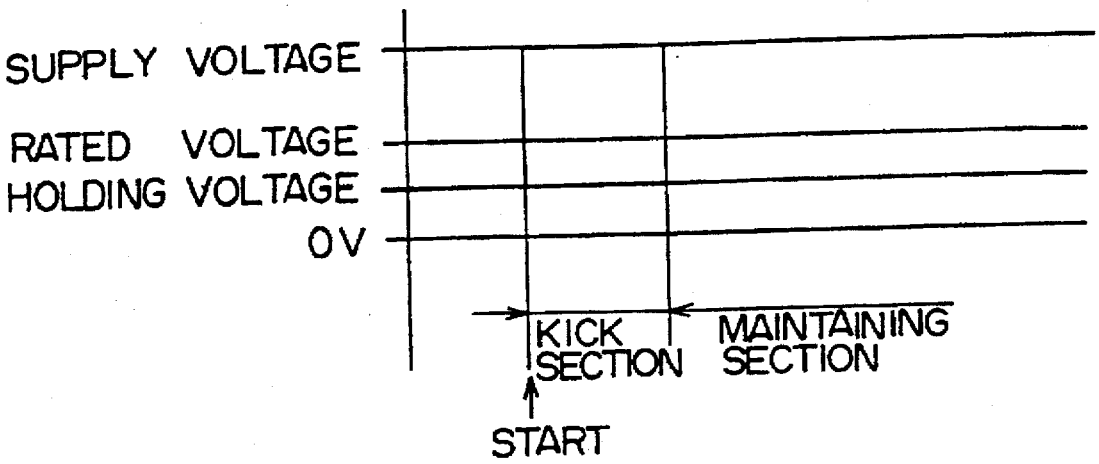
FIG. 11 is a timing chart showing the timing of the operation of the invention at the starting of a solenoid.

If N balls dispensing is ordered, the dispensing operation of the balls by CPU of said controller 50 will be explained in detail using the flow chart of the FIG. 13. When dispensing prize balls, the controller 50 outputs the instruction which starts the main solenoid 150 and sub-solenoid 160 to the each drive circuit (step 301. if the dispensing balls are less than the prescribed number, the controller 50 outputs the instruction to only the drive circuit of the main solenoid 150.). Then, as shown in FIG. 11, both the transistor 194 and 195 of the drive circuit 190 at the fixed time (kick section) mentioned earlier will become ON, and the supply voltage 24V will directly be impressed onto the coil 150*b* of the main solenoid 150 and the coil 150*b* of the sub-solenoid. A large current (500 mA at the above condition) will flow mainly via the transistor 194. After passing the kick section, in the maintaining section, the controller 50 makes only the transistor 194 be OFF. In this condition, a small current (128 mA at the above condition) will flow through said each coil via the transistor 195, and the impressed voltage will become the holding voltage of of 6.1V.

As a result, the main solenoid 150 and the sub-solenoid 160 operate, and the main stopper 130 and the sub-stopper 140 will be released from the ratchet wheel 120 to be maintained as shown in FIG. 8. Then sprocket 110 continuously rotates at a fast speed by the weight of the pachinko balls, and the pachinko balls are dispensed speedily one after another. However, the rotation of this sprocket 110 is controlled to a maximum speed at which skidding does not occur, by the operation of the governor 55 described earlier.

During dispensing of the pachinko balls, the controller 50 is counting the number of pachinko balls (from now on referred to as "the dispensed number") H dispensed until then, based on the detecting signal of the detecting means 183. Then, this number is subtract from the number N of pachinko balls (from now on referred as "set dispensing number"), and it is decided whether this difference (N–H) has become the previously set minute value (step 302). The minute value is preferred to be 2 to 5. As a result of the decision, if the difference is at the minute value, the controller 50 controls the sub-solenoid 160 to be OFF, and the main solenoid 150 is intermittently operated until the dispensing number (N) equals the instructed value (step 303). The intermittent operation can be done by sending a cyclic pulse signal for the main solenoid 150 to the input terminal of the drive circuit.

When this kind of intermitent operation carried out, the main stopper 130 and the sub-stopper 140 engages with the sprocket 110 alternately. In this case, the sprocket 110 turns bythe angle corresponding to half the concave portion 110*a*, from the time the engagement with the main stopper 130 is released until being engaged with the sub-stopper 140. Similarly, the sprocket 110 turns by an angle corresponding to half the concave portion 110*a*, from the time the engagement with the sub-stopper 140 is released until being engaged with the main stopper 130. Therefore, as one cycle of an intermittent operation is made, one pachinko ball is dispensed.

When the controller 50 decides that the dispensing number N has reached the set dispensed number H, the controller 50 outputs the ending indication of the main solenoid 150 and the sub-solenoid 160 to the drive circuit 190. According to this, the drive circuit 190 controls the transistor 194 and the transistor 195 to be OFF and stops the dispensing.

Figure 13:
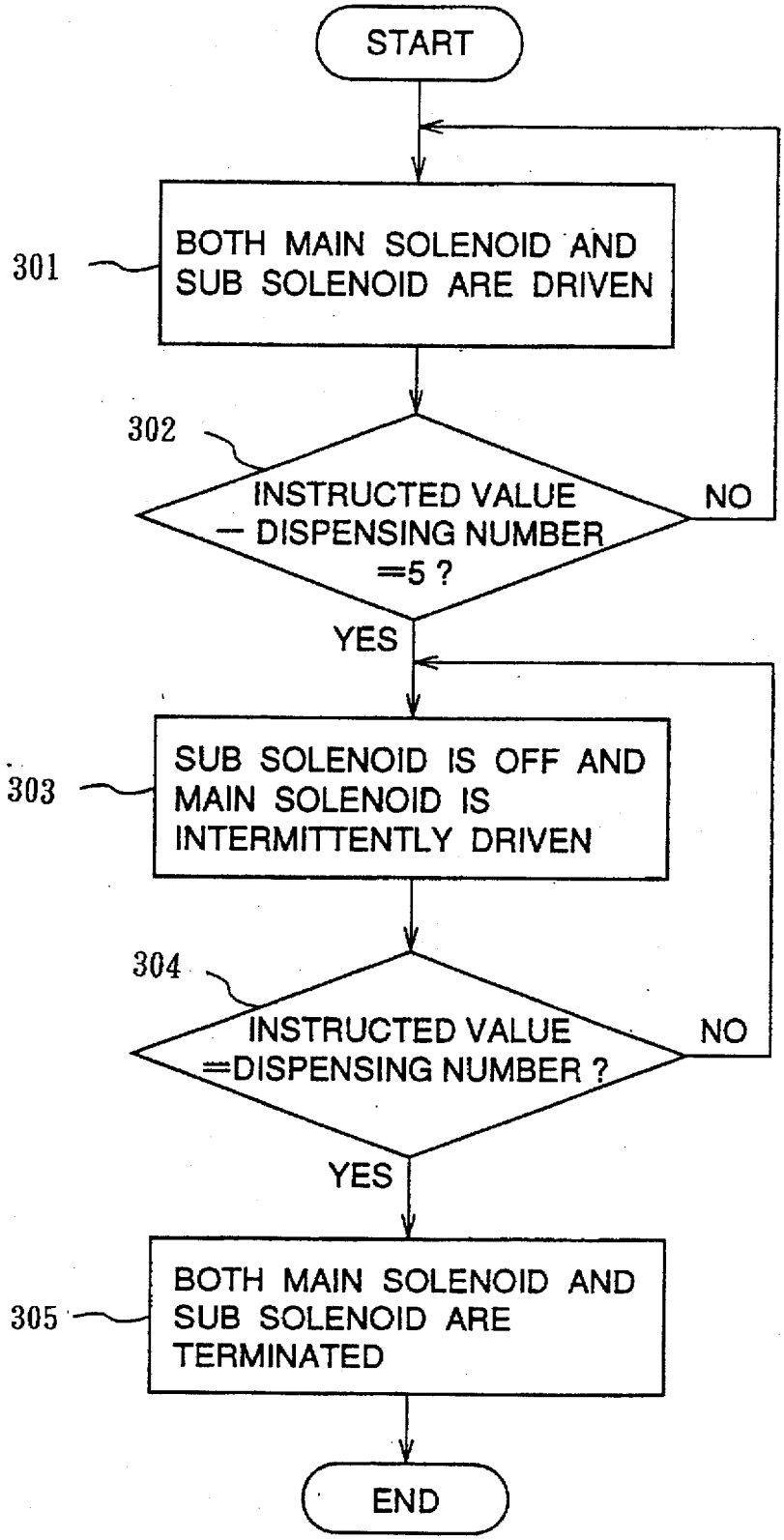
FIG. 13 is a flow chart showing the operation of the controller.

Further, the supply condition of the pachinko balls in the ball passage 170 is observed by the controller, having CPU, according to the output signal of the detecting means 182, although not shown in the flow chart in FIG. 13. In other words, when the supply of the pachinko balls to the ball passage 170 is interrupted, the alarm signal is outputted, for some suitable measures to be taken. Furthermore, the controller observes whether one pachinko ball is dispensed corresponding to one rotation of the concave portion 110*a* of the sprocket 110, by comparing the output signal of the detecting means 181 and that of the detecting means 183. Thus, when skidding has occurred in the sprocket 110, this is detected at once, making it possible to somehow cope with.

By means of the above-mentioned pachinko ball dispenser or the method for dispensing pachinko balls, until the dispensing number approaches the dispensed number, the sprocket 110 is rotated continuously by the weight of the pachinko balls. Thus, the pachinko balls can be dispensed continuously at high speed during this time. When the dispensing number approaches the dispensed number, it changes to an intermittent operation, and the pachinko balls are dispensed one by one. Therefore, no excess pachinko balls are dispensed because of a delay in stopping the rotation of the sprocket 110. The exact number of pachinko balls according to the direction can be dispensed. Further, as most of the pachinko balls are dispensed at a condition where the sprocket 110 is revolving at a high speed, the dispensing speed as a whole can be high.

Moreover, the reliability in operation of the main solenoid 150 and the sub-solenoid 160 is highly obtainable by the construction of the drive circuit described earlier. The skidding of the wheel 110 is also prevented by the operation of the governor 122 described earlier. Troubles can be fastly dealt with by the processing based on the detecting result of the detecting means 181 and the detecting means 182.

Industrial Applicability

The game machine of the game aparatus of the present invention has a pachinko ball dispenser which receives a renting signal output from a controller according to a money signal from a rental ball despensing unit and a prize signal output from the controller in accordance with prescribed rules, and the pachinko ball dispenser dispenses pachinko balls according to said each signal into a ball tray; therefore, in one game machine, dispensing of the pachinko balls can do by only one pachinko ball dispenser. And the parts of the game machine decreases, therefore, the cost of producing the game machine can be lowered, and the accident such as pachinko ball jamming decreases. Thus, the present invention can dispense the pachinko balls efficiently and players can enjoy the game without interruptions.

Furethermore, using the method of dispensing the pachinko balls of the present invention, dispensing the optional number of the pachinko balls accurately and fast can be done by only a kind of dispenser; therefore, the method is most suitable for the game machine of this invention. If the dispenser used at each necessary portion in a pachinko island, the dispensing operation of said each portion can be more accurate and faster, and what is more, the cost of producing the pachinko island can be lowered by using standardized pachinko ball dispensers.

We claim:

1. A game machine, comprising:

a pachinko ball dispensing unit;

a game machine unit using pachinko balls as a game medium;

means for integrated control of said pachinko ball dispensing unit and said game machine;

an overflow sensor means for outputting a signal for stopping dispensing of said pachinko balls;

a gained pachinko ball display;

an inserted ball number display;

recording media issuing means;

said pachinko ball dispensing unit having a money identification means for identifying an amount of money placed into said pachinko ball dispensing unit and for sending to said control means an amount signal corresponding to any one of said money amount placed into said pachinko ball dispensing unit and a ball signal equivalent to said amount of money placed into said pachinko ball dispensing unit;

said control means having means for outputting a dispensing signal based on said amount signal from said pachinko ball dispensing unit and for outputting a prize signal based on a set of predetermined rules;

said game machine unit having a pachinko ball dispenser which has means for receiving said dispensing signal outputted from said control means and said prize signal also outputted from said control means, for calculating a number of said pachinko balls which corresponds to said dispensing and prize signals, and for dispensing said pachinko balls into a ball tray;

said overflow sensor means having means for detecting a state of said ball tray being filled with said pachinko balls dispensed from said pachinko ball dispenser and for stopping dispensing of said pachinko balls by said pachinko ball dispenser via said control means after sending a fill signal to said control means;

said gained pachinko ball display having means for indicating an amount of said pachinko balls after subtracting a number of said pachinko balls dispensed into said ball tray from a total number of said pachinko balls to be dispensed;

said inserted ball number display having means for indicating an amount of said pachinko balls inserted for gaming; and said recording media issuing means having means for recording a number of player's total keeping balls, equal to a sum of said pachinko balls indicated with said gained pachinko ball display and said pachinko balls in said ball tray, on a recording medium, and for electing a recorded recording medium.

2. A game machine as claimed in claim 1, further comprising:

a supply gutter mounted in a game machine island for supplying said game machine unit with said pachinko balls, said supply gutter and said pachinko ball dispenser being connected together by pipes.

3. The game machine as in claim 1, further comprising a gaming face, wherein said gaming face has variable display sections for indicating various kinds of patterns.

4. The game machine as in claim 3, further comprising stopping switches, wherein said stopping switches have means for stopping said patterns changing on said variable display sections.

5. A pachinko ball dispenser for dispensing a prescribed number of pachinko balls, comprising:

a pachinko ball passage;

a sprocket formed with a plurality of peripheral concave portions, wherein each peripheral concave portion of said plurality of peripheral concave portions is for catching one falling pachinko ball, respectively, said sprocket being rotatably mounted with said concave portions facing towards an interior of said pachinko ball passage;

a rachet wheel coupled to and rotated together with said sprocket;

a main stopper mounted movably on a side portion of said rachet wheel, for stopping rotation of said sprocket by engaging one end of said main stopper with any one tooth of teeth of said ratchet wheel when said ratchet wheel moves in one direction;

a main actuator means for moving said main stopper;

a sub-stopper mounted to move together with said main stopper when said sub-stopper is not pressed by an external force which exceeds a prescribed force, said sub-stopper being adapted to rotate said sprocket only at an angle corresponding to one half of a width of any one peripheral concave portion of said plurality of peripheral concave portions by engaging one end of said sub-stopper with any one tooth of said teeth of said ratchet wheel when said main stopper comes out of said ratchet wheel by moving in a direction opposite to said one direction;

a sub-actuator means for moving said sub-stopper towards a direction to remove said sub-stopper from said ratchet wheel by pressing said sub-stopper with an external force greater than said prescribed force regardless of a movement of said main stopper;

a dispensing ball detecting means for detecting and counting said pachinko balls dispensed from a lower portion of said pachinko ball passage;

a controller having means for maintaining said main stopper and said sub-stopper in a disengaged state with said sprocket by controlling an action of said main actuator means and said sub-actuator means until a number of detected dispensed balls reaches an amount near to an ordered number of said pachinko balls, and for, after said number of detected dispensed balls reaches an amount near to said ordered number of said pachinko balls, engaging said main stopper and said sub-stopper with said sprocket alternately by operating only one of each of said main actuator means and said sub-actuator means, so as to establish intermittent operation.

6. A pachinko ball dispenser as claimed in claim 5, further comprising:

at least one of said main actuator means and said sub-actuator means having a solenoid, said controller having a drive circuit which has means for applying an exciting voltage to a respective solenoid for operating any one of a respective main stopper, a respective sub-stopper, and both said respective main stopper and said respective sub-stopper, for applying said exciting voltage larger than a holding voltage for said solenoid for a prescribed time just after beginning driving and for applying said holding voltage of said solenoid as said exciting voltage after passing of said prescribed time.

7. A method of dispensing an ordered number of pachinko balls, comprising the steps of:

providing a dispenser having a sprocket formed with a plurality of peripheral concave portions, each peripheral concave portion of said plurality of periperhal concave portions for catching one falling pachinko ball, respectively, said sprocket being rotatably mounted with each of said peripheral concave portion of said plurality of peripheral concave portions facing towards an interior of a pachinko ball passage and having a main stopper and a sub-stopper for controlling rotation of said sprocket;

disengaging said main stopper and said sub-stopper from said sprocket for continuously rotating said sprocket by dropping said pachinko balls within said pachinko ball passage to continuouly rotate said sprocket until a number of said pachinko balls dispensed reaches an amount which is near to a number of said pachinko balls ordered;

changing said continuous rotation of said sprocket to an intermittent rotation repeating a small angle of rotation corresponding to a movement of one of each of said peripheral concave portion of said plurality of peripheral concave portions by alternately engaging said main stopper and said sub-stopper with said sprocket and disengaging said main stopper and said sub-stopper from said sprocket; and stopping said intermittent rotation of said sprocket to stop rotation of said sprocket when said number of said pachinko balls dispensed is equal to said number of said pachinko balls ordered.

* * * * *